US010267572B2

(12) United States Patent
Kaestle et al.

(10) Patent No.: US 10,267,572 B2
(45) Date of Patent: Apr. 23, 2019

(54) FLAT TUBE AND HEAT EXCHANGER HAVING A FLAT TUBE OF SAID TYPE

(71) Applicant: MAHLE International GmbH, Stuttgart (DE)

(72) Inventors: Christoph Kaestle, Ulm (DE); Steffen Marx, Munich (DE)

(73) Assignee: MAHLE International GmbH, Stuttgart (DE)

( * ) Notice: Subject to any disclaimer, the term of this patent is extended or adjusted under 35 U.S.C. 154(b) by 245 days.

(21) Appl. No.: 14/584,356

(22) Filed: Dec. 29, 2014

(65) Prior Publication Data

US 2015/0107811 A1 Apr. 23, 2015

Related U.S. Application Data

(63) Continuation of application No. PCT/EP2013/063618, filed on Jun. 28, 2013.

(30) Foreign Application Priority Data

Jun. 29, 2012 (DE) ..... 10 2012 211 350

(51) Int. Cl.
*F28F 1/12* (2006.01)
*F28F 3/02* (2006.01)
*F28D 1/03* (2006.01)

(52) U.S. Cl.
CPC ..... *F28F 1/12* (2013.01); *F28D 1/0391* (2013.01); *F28F 3/025* (2013.01)

(58) Field of Classification Search
CPC ..... F28F 1/12; F28F 3/025; F28D 1/0391
See application file for complete search history.

(56) References Cited

U.S. PATENT DOCUMENTS 4,570,700 A * 2/1986 Ohara ..... F25B 39/02 165/134.1
6,563,709 B2 5/2003 Negishi et al.
7,107,680 B2 9/2006 Ueda
(Continued)

FOREIGN PATENT DOCUMENTS

CN 1323802 C 7/2007
CN 101539376 A 9/2009
(Continued)

OTHER PUBLICATIONS

Chinese Office Action for Chinese Appilcation No. 201380033763.X dated Mar. 16, 2016 with English translation.

*Primary Examiner* — Keith Raymond
*Assistant Examiner* — Gordon Jones
(74) *Attorney, Agent, or Firm* — Muncy, Geissler, Olds & Lowe, P.C.

(57) ABSTRACT

A flat tube, in particular for a heat exchanger, is provided that has an areal material strip with two mutually opposite first and second side walls which are connected to one another via third and fourth side walls, wherein the third side wall is formed by two sections of the material strip that are laid one against the other in double-layer form, wherein an internal fin is arranged in the interior of the flat tube, which fin, at the end sides, bears against the third side wall and against the fourth side wall, and which fin, between the third side wall and the fourth side wall, is supported alternately against the first side wall and against the second side wall.

8 Claims, 7 Drawing Sheets

(56) References Cited

U.S. PATENT DOCUMENTS

| | | | | |
|---|---|---|---|---|
| 9,038,267 | B2 * | 5/2015 | Schmid | B21C 37/225<br>225/103 |
| 2006/0086491 | A1 * | 4/2006 | Ueda | B21D 53/02<br>165/177 |
| 2006/0283585 | A1 | 12/2006 | Smith et al. | |
| 2007/0095514 | A1 | 5/2007 | Inoue et al. | |
| 2007/0119581 | A1 | 5/2007 | Kato | |
| 2010/0051252 | A1 | 3/2010 | Ninagawa et al. | |
| 2011/0005738 | A1 | 1/2011 | Vetter et al. | |

FOREIGN PATENT DOCUMENTS

| | | | |
|---|---|---|---|
| DE | 10 2005 050 366 | A1 | 4/2006 |
| DE | 10 2006 050 319 | A1 | 5/2007 |
| DE | 10 2006 035 210 | A1 | 1/2008 |
| DE | 10 2006 054 814 | A1 | 5/2008 |
| DE | 10 2008 033 883 | A1 | 4/2009 |
| EP | 1 243 884 | A2 | 9/2002 |
| EP | 1 681 528 | A1 | 7/2006 |
| FR | 2 869 679 | A1 | 11/2005 |
| JP | 05-115934 | A | 5/1993 |
| JP | 2002-098454 | A | 4/2002 |
| JP | 2005-106389 | A | 4/2005 |
| WO | WO2008/011115 | A2 * | 1/2008 |

* cited by examiner $B_k$
27
$B_v$
25
23
26
21
22
24
20
S
H
32
34
$B_u$
36
35
30
33
31

23
34
21
36
36
30
20
36
24
33
22
36

38
37

23
29
26
37
27
21
28

40
41
42
43
44
45
46
47
48
49
50
51
52
53
54
55
56
α
β
γ

FLAT TUBE AND HEAT EXCHANGER HAVING A FLAT TUBE OF SAID TYPE

This nonprovisional application is a continuation of International Application No. PCT/EP2013/063618, which was filed on Jun. 28, 2013, and which claims priority to German Patent Application No. 10 2012 211 350.9, which was filed in Germany on Jun. 29, 2012, and which are both herein incorporated by reference.

BACKGROUND OF THE INVENTION

Field of the Invention

The invention relates to a flat tube, in particular for a heat exchanger, having a flat material strip having two mutually opposing first and second side walls that are connected to one another via third and fourth side walls. The invention also relates to a heat exchanger having such a flat tube.

Description of the Background Art

Flat tubes for heat exchangers are known in many configurations in the prior art. For instance, extruded flat tubes having a plurality of bars for forming individual fluid channels for capacitors or evaporators have been known for some time.

So-called bridge tubes, in which a metal strip is folded over to create for instance a single or multi-chamber tube, such as for instance a B tube, are also known. These folded tubes are typically first sealed using the soldering process for soldering the entire heat exchanger and have at least one or two fluid chambers through which a medium can flow.

DE 102006054814 A1, which corresponds to US 20110005738, discloses a soldered flat tube for capacitors or evaporators in which the tube is formed from two half shells that overlap on the short sides and are soldered there, wherein a fin is arranged in the interior space such that this fin is also positioned in the overlapping tube area and is soldered to the tube wall there.

However, there are problems with this example with respect to the complexity of manufacture and with respect to the resulting costs, since production of the multi-part tube with interior fin means increased production complexity, both in the manufacture and in the assembly of at least three parts that are joined to create one tube.

DE 102006050319 A1, which corresponds to US 20070095514, discloses a flat tube that is formed from a sheet metal strip, wherein the sheet metal strip is bent such that the closure of the sheet metal strip is arranged at a short side of the tube. Likewise arranged in the interior of the tube is a fin that is accommodated in the region of the connection of the sheet side edges between these side edges.

This tube design has drawbacks with respect to space requirements, because the lateral closure of the tube limits the space that is available for the interior of the tube.

EP 1243884 A2, which corresponds to US 20040182559, discloses a flat tube that is formed from a sheet metal strip, wherein a center bar is provided that is formed by a hook-like molding of the edge regions of the sheet metal strip, wherein a corrugated fin is arranged in the interior space of the tube.

The tube design in EP 1243884 A2 suffers from the drawback that the interior pressure stability is not optimal, especially in the central region of the bar, and during use under higher pressures there can be leaks, especially in the region of the solder point.

SUMMARY OF THE INVENTION

It is therefore an object of the invention to provide a flat tube and a heat exchanger having a flat tube, wherein the flat tube is simple to manufacture and nevertheless is equipped with increased pressure stability. With respect to the heat exchanger, an object is to provide a heat exchanger that has increased pressure stability, especially in the region of the flat tubes thereof.

An exemplary embodiment of the flat tube according to the invention provides a flat tube, in particular for a heat exchanger, having a flat material strip having two mutually opposing first and second side walls that are connected to one another by means of third and fourth side walls, wherein the third side wall is formed by two sections of the material strip that are positioned one against the other in a double-layer, wherein an internal fin is arranged in the interior of the flat tube, which fin at its end sides is positioned against the third side wall and against the fourth side wall, and which fin, between the third side wall and the fourth side wall, is supported alternately against the first side wall and against the second side wall. In this manner it is possible to create a highly stable flat tube that satisfies the requirements for stability and corrosion resistance and at the same time is easy to manufacture.

The third side wall can have an angled or curved contour.

The fourth side wall can have an angled or curved contour.

It is advantageous when the internal fin at its one end region is curved or angled and is positioned against the third side wall and at its other end region is curved or angled and is positioned against the fourth side wall.

It is also useful when one end region of the internal fin is accommodated between two sections of the material strip that form the third side wall and that are positioned against one another in a double layer. This ensures that the internal fin is connected on both sides to the third side wall. This represents a particularly stable embodiment.

It is furthermore useful when the third side wall is formed with one inner material strip and one outer material strip.

It is advantageous when, in the transition region from the first side wall to the third side wall, an arc, step, or incline is provided on the inner material strip, wherein the outer material strip is positioned against the inner material strip and terminates in the region of the arc, step, or incline of the inner material strip.

It is also useful when the end of the outer material strip fits the contour of the inner material strip in the region of the arc, step, or incline and essentially forms a flush closure.

The flat tube can be provided with a tube width between 9 mm and 60 mm, and/or with a tube height between 1.5 mm and 30 mm, and/or with a wall thickness s for the material strip between 160 μm and 500 μm, and a wall thickness for the inner fin between 60 and 200 μm.

It is also advantageous when, prior to insertion into the material strip, the dimensions of the inner fin can be larger than the inner dimensions of the material strip such that the inner fin can be inserted under pre-stress into the material strip.

It is also useful when, prior to insertion into the material strip, the dimensions of the inner fin can be smaller than or equal to the inner dimensions of the material strip such that the inner fin can be inserted without pre-stress into the material strip.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
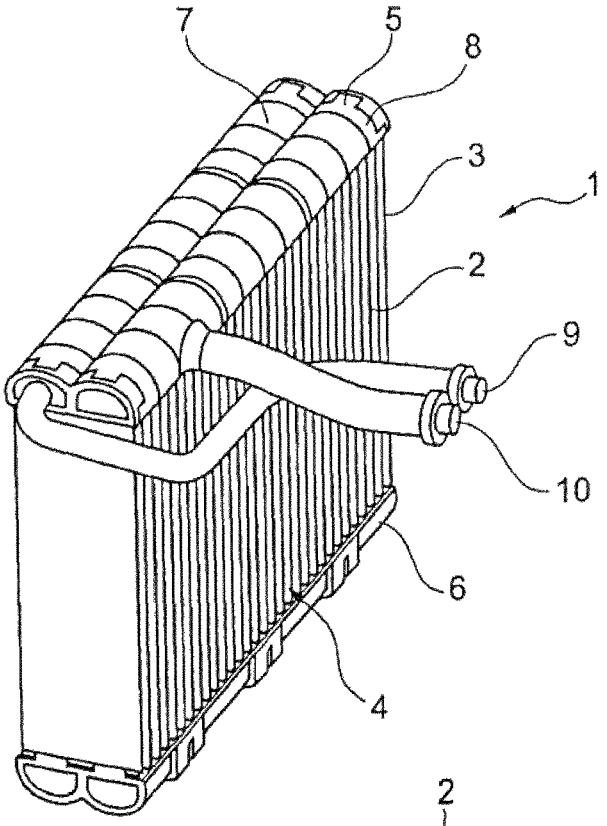
FIG. 1 depicts a view of a heat exchanger, such as in particular an evaporator, having flat tubes according to the invention.

FIG. 1 depicts a heat exchanger 1, such as in particular an evaporator, in a perspective view. The evaporator 1 has a tube fin block 2 having flat tubes 3 and fins 4 arranged between the flat tubes. At the two opposing ends thereof the flat tubes 3 are in fluid communication with the collecting boxes 5 and 6, the upper collecting box 5 having two chambers 7, 8, the chamber 7 being the inlet-side chamber that is connected to an inlet connection tube 9, and the chamber 8 being the outlet chamber that is connected to an outlet connection tube 10. The lower collecting box 6 advantageously has at least one chamber that effects a deflection at the bottom. The inlet connection is advantageously arranged laterally on the short side of the collecting box and preferably on the Lee side of the heat exchanger. The outlet connection is preferably arranged in front on a longitudinal side of the collecting box and preferably on the Luv side of the heat exchanger.

Figure 2:
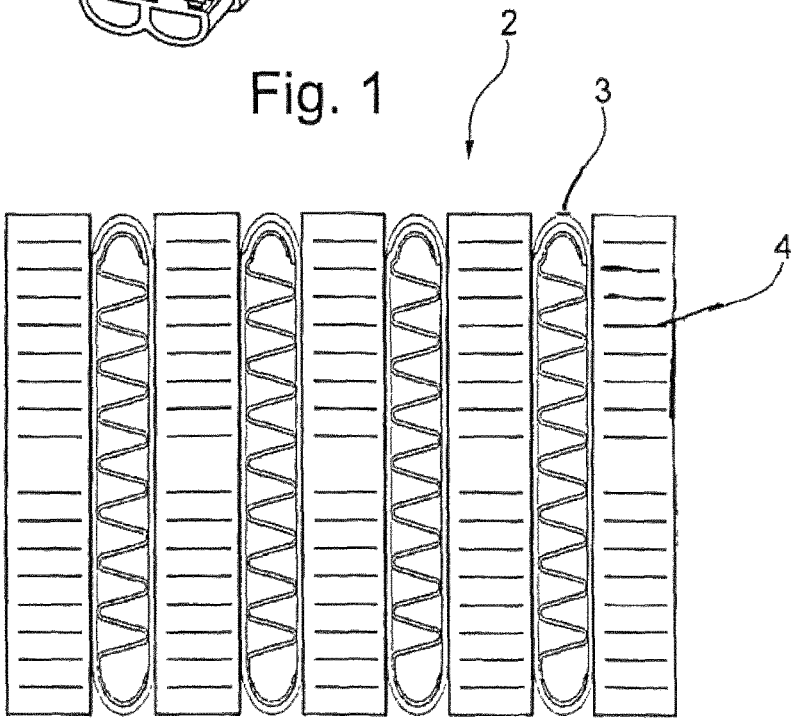
FIG. 2 depicts a view of a section through part of an evaporator in which flat tubes according to the invention and adjacently arranged corrugated fins can be seen.

FIG. 2 depicts a section through the tube fin block 2 in FIG. 1, the flat tubes 3 and the corrugated fins 4 being arranged alternately adjacent to one another. The flat tubes 3 are depicted in section such that the fluid that flows through the flat tubes 3 flows through the tubes quasi-perpendicular to the plane of the drawing. The corrugated fins are depicted only schematically, air flowing through the corrugated fins quasi-parallel to the plane of the drawing.

Figures 3A, 3B:
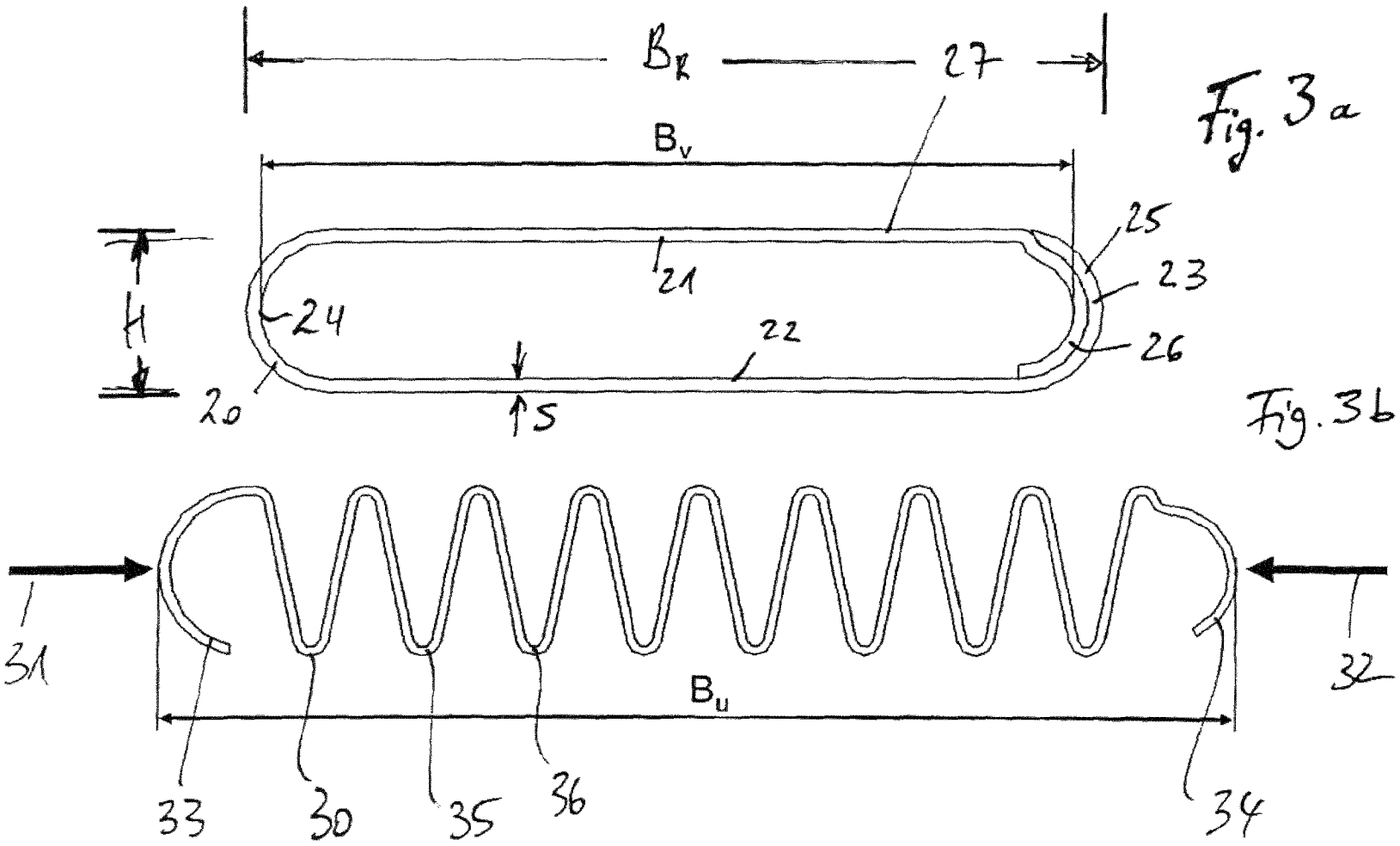
FIG. 3*a* depicts a section through a flat tube according to the invention without an inner fin.
FIG. 3*b* depicts a section through an inner fin of a flat tube.

FIG. 3*a* depicts a flat tube 20 in section, wherein the flat tube has two mutually opposing first and second side walls 21, 22 and two mutually opposing third and fourth side walls 23, 24, wherein the third and fourth side walls 23, 24 connect the first and second side walls 21, 22 to one another. Thus side 24, as the fourth side, connects the first and second side walls 21 and 22 on the left side in the exemplary embodiment in FIG. 3*a* and the third side wall 23 connects the first and second side walls 21 and 22 on the right side in the exemplary embodiment. The flat tube can be recognized as such, which means that the third and fourth side walls 23, 24 are significantly shorter in their extension than the extension of the first and second side walls 21, 22.

As is apparent, the first, second, and fourth side walls 21, 22, 24 are each provided in a single layer, the third side wall 23 being formed by two sections 25, 26 of the material strip 27 of the flat tube, which sections, positioned one against the other in a double layer, form a type of double wall. In the exemplary embodiment in FIG. 3*a* it is advantageous that the third and fourth side walls 23, 24 are curved. Curved can preferably mean semi-circular or curved in another manner. The third side wall 23 has an inner wall and an outer wall, the inner wall transitioning with a step into the curved contour proceeding from the first side wall 21 such that the end region of the outer side wall is positioned against the region of this step. The inner axial length $B_V$ is shown by the arrow.

The tube width, that is, the outer extension in the lateral direction, that is, $B_V$ plus the wall thickness of each of the third and fourth side walls 23, 24, is preferably between 9 mm and 60 mm, particularly advantageously between 10 mm and 30 mm. The tube width is identified as $B_R$. The tube height H is advantageously between 1.5 mm and 30 mm. The wall thickness s of the outer contour is between 160 μm and 500 μm, preferably 180 μm to 250 μm.

FIG. 3*b* illustrates the inner fin that is provided to be inserted into the flat tube 20. The inner fin 30 is provided in a length $B_U$ that is longer than the inner length $B_V$ of the flat tube. If the inner fin 30 is now inserted into the flat tube 20, the former is first compressed in the lateral direction in accordance with the arrows 31, 32 such that the inner fin 30 is arranged under pre-stress in the flat tube 20. The inner fin 30 is designed such that a curved contour, which transitions into a meandering contour 35 with fins and curves, is provided at the two end regions 33, 34. This means that the curved contours of the inner fin 30 in the region 33, 34 are positioned against the curved contours of the flat tube and the curves 36 of the meandering structure 35 are positioned on the interior against the first and second side walls of the flat tube. This results in a flat tube that has a very stable configuration after soldering. The wall thickness of the inner fin is preferably in the range of 60 to 200 μm. The number of fins is preferably 2 to 20.

In another exemplary embodiment, it is advantageous when the inner fin 30 is only positioned against a tube radius 33. The region 34 is in particular in the overlap region of the fold and can be slightly elevated such that there is a gap between regions 34 and 33.

Figure 4:
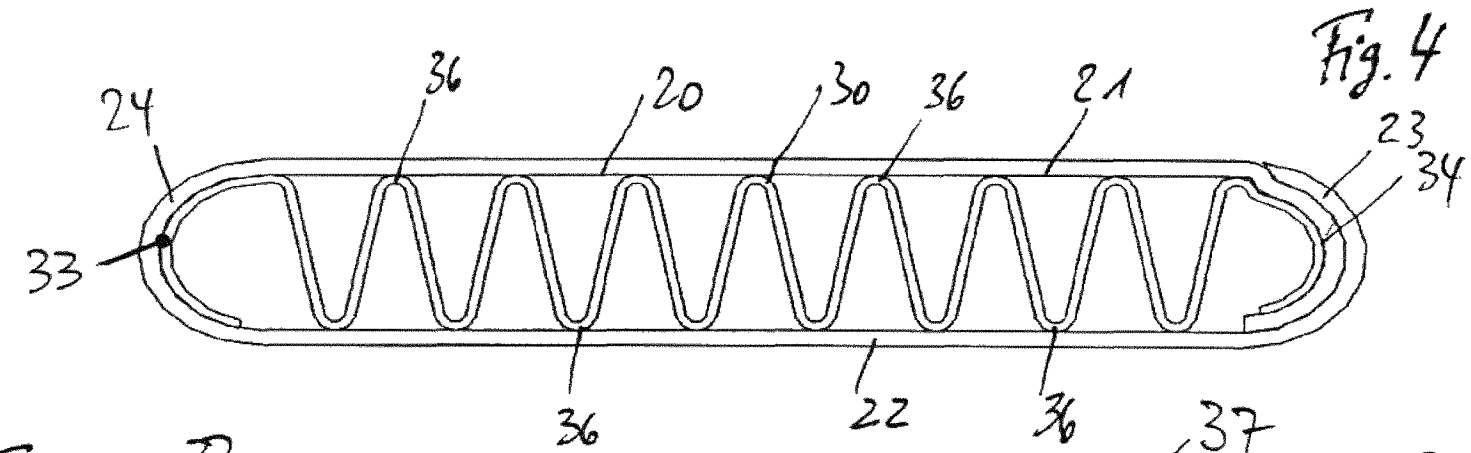
FIG. 4 depicts a section through a flat tube in accordance with FIG. 3*a* with inner fin in accordance with FIG. 3*b;*

FIG. 4 illustrates flat tube 20 with the inner fin 30 in the assembled state. The curved region 33 and the curved region 34 of the inner fin 30 are positioned on the interior flush against the curved regions of the third and fourth side walls 23, 24 of the flat tube 20. The curves 36 are positioned on the interior against the essentially flat inner side of the first and second side surfaces 21, 22 of the flat tube 20.

Figure 5:
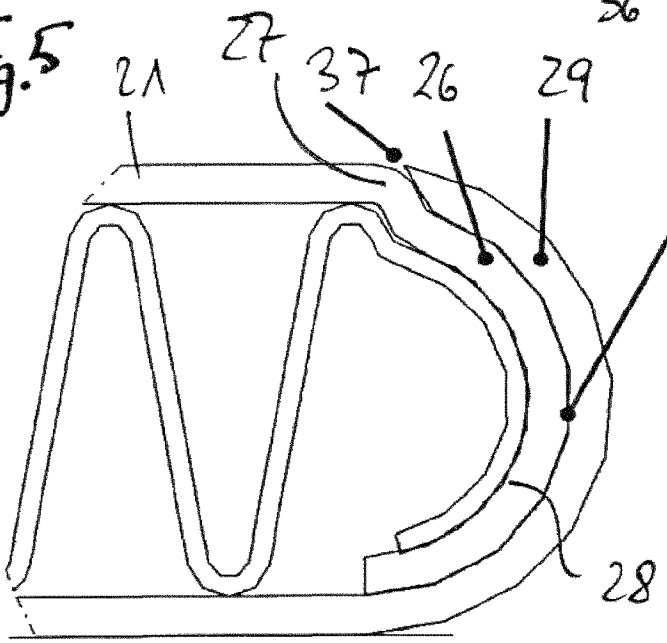
FIG. 5 depicts a detail in accordance with FIG. 4.

FIG. 5 illustrates an enlarged detail of the end region with the third side wall 23, which is provided in a double layer. The inner band edge or the inner section of the material strip 26 is provided by a step or by an angled section 27 such that starting at this step or angling it departs from the plane or straight line of the first side wall 21 and transitions to the curved end region 28. The outer band edge or the outer section of the material strip 29 is tapered such that in the contact region of the first and second band edges or in the contact region between the end of the first section and the step of the second section there is a tapering or rounding so that the inclines in this region fit.

The fitting of the end of the band occurs using a roll forming unit such that the end of the band can be fitted to the step of the band edge or of the first section in order to also be able to minimize the delta diameter 37. The region of the delta diameter can preferably be filled, at least in part, with solder after the soldering process so that an essentially smooth transition area is found exteriorly on the tube.

Figure 6:
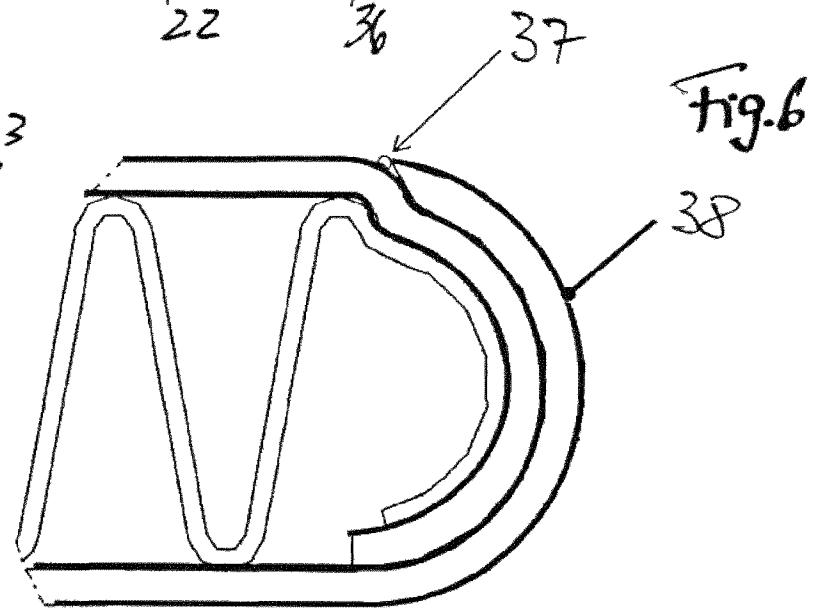
FIG. 6 depicts a detail in accordance with FIG. 4.

FIG. 6 depicts the exemplary embodiment from FIG. 5 again in another illustration, wherein the delta diameter 37 can be seen. The heavier dark lines indicate the solder plating 38 on the band as tube material that is preferably provided on the two sides of the material strip. Due to this the soldering of the double-layer wall region can be optimized, wherein it is also possible to solder to the inner fin, which is preferably not provided with solder plating.

Figures 7, 8, 9:
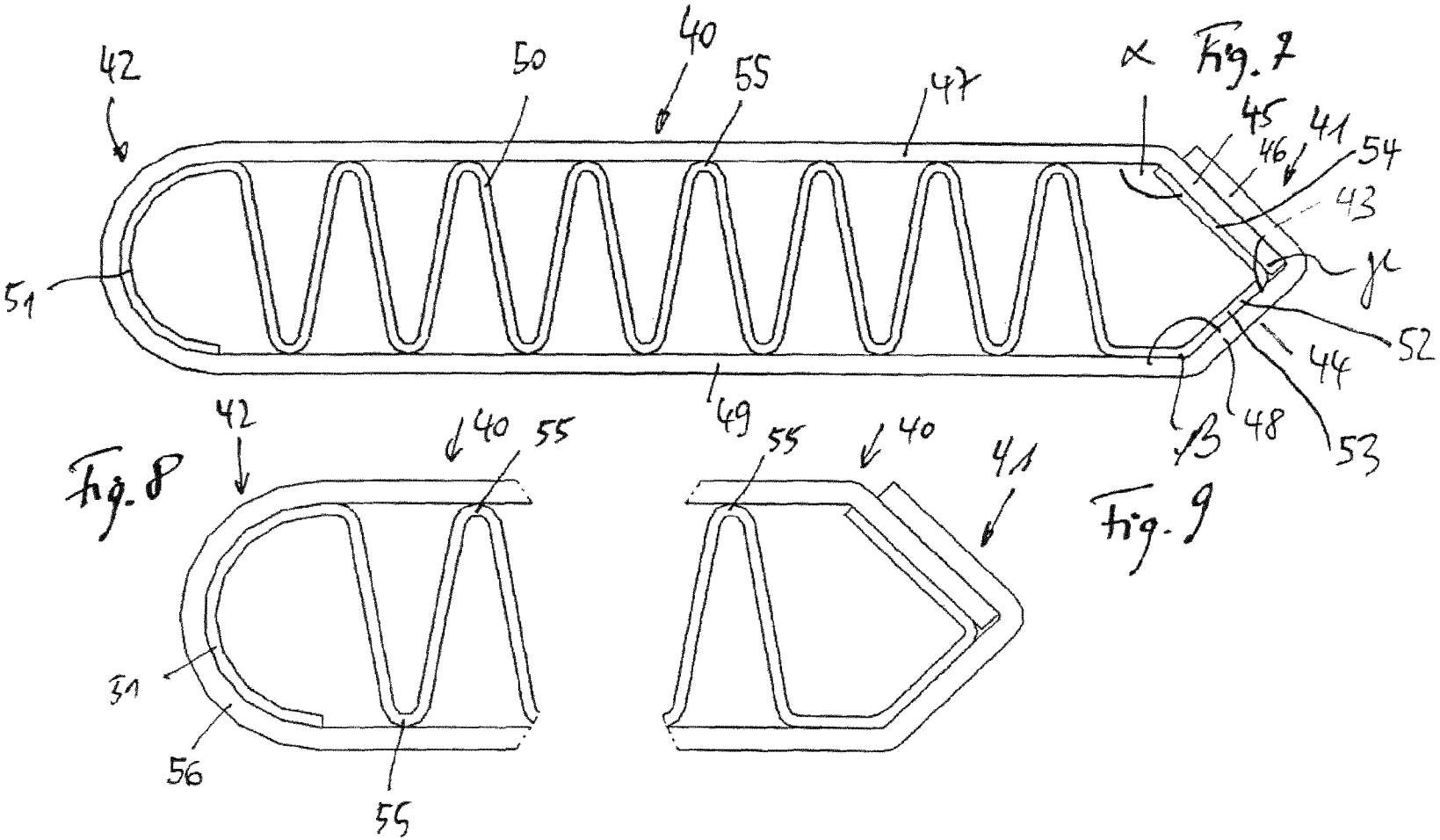
FIG. 7 depicts a section through an exemplary embodiment of a flat tube.
FIG. 8 depicts a detail in accordance with FIG. 7.
FIG. 9 depicts a detail in accordance with FIG. 7.

FIG. 7 illustrates, in another exemplary embodiment, a flat tube 40 that is provided as an angle or angled at the third side wall 41, while the tube is provided with a curved shape on the fourth side wall 42. The region of the third side wall 41 is designed such that it comprises two sub-regions 43, 44 that are disposed essentially at an acute angle to one another, wherein the region 43 is the double-walled or double-layer region that is formed in a double layer from two sections of the material strip, the ends of which are placed over one another. To this end a first end region 45 and a second end region 46 of the material strip are angled such that the two material strips are oriented parallel to one another. For this, the material strip 45 is angled from the first side wall 47 at an angle $\alpha$ of approximately 135°, the region 48 is angled from the second side wall 49 by the angle $\beta$, and the region 46 is angled from the region 48 at the angle Y such that the two regions 45 and 46 of the third side wall are parallel to one another and are in a double layer adjacent to one another. The end face of the region 45 is either positioned against the region 48 or is a slight distance therefrom.

At its one end, the inner fin 50 has a curved course 51 that is positioned against the curved course of the fourth side wall of the flat tube. At the opposing end, the inner fin 50 has an angled course 52 that is formed from two regions that are at an angle to one another, wherein one region 53 is positioned against the region 48 of the flat tube and one region 54 is positioned against the region 45 of the flat tube. Between the two lateral end regions, the inner fin 50 is arranged in the region of the curves 55 such that the inner fin is positioned against the first or second side wall.

FIGS. 8 and 9 illustrate the two end regions of the flat tube again, this time in an enlargement. The region 51 is essentially designed in a semicircular curve and is positioned against the second side wall 56. Starting from the semicircle, the inner fin takes a meandering course, wherein the curves 55 resulting therefrom are each positioned in opposition against the first or second side wall. In the region of the third side wall, which, as described above, is provided in an angle, wherein in one region of the angle the side wall is provided in a single layer and in another region of the side wall the angle is provided in a double layer, the inner fin is in an angle positioned against these two regions.

Figure 10:
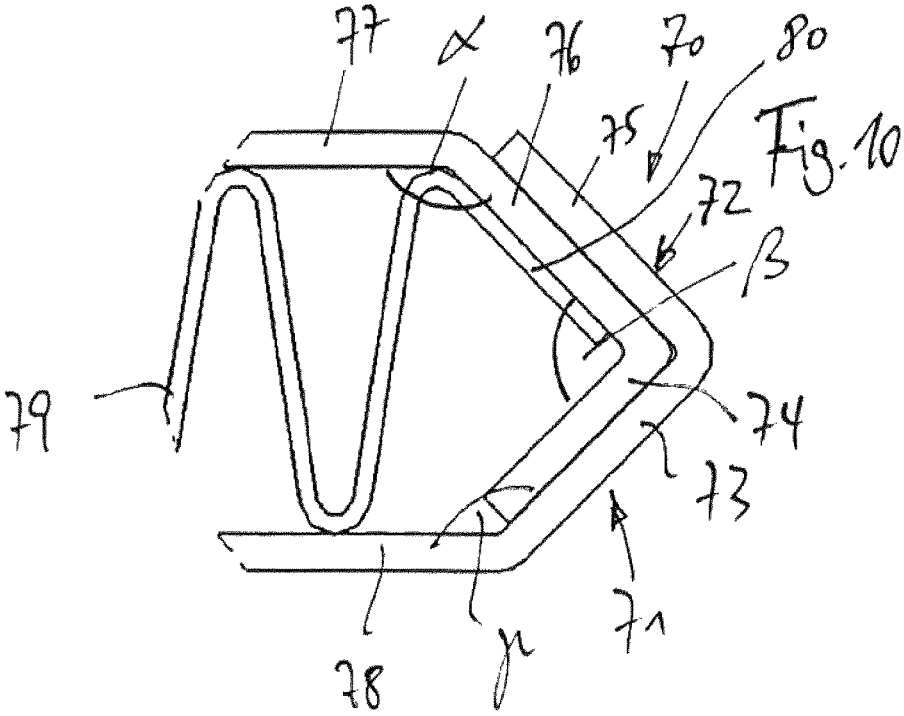
FIG. 10 depicts a section through part of one exemplary embodiment of a flat tube.

FIG. 10 illustrates an end region of a flat tube that is provided at one end region in a manner alternative to the exemplary embodiment in FIGS. 7, 8, and 9. The region of the third side wall 70 is angled, wherein the double-layer design is provided using two legs of the angular side wall. The side wall 70 has a first leg 71 and a second leg 72, each of which are formed by a layer 73 and 74 or 75 and 76. Proceeding from the first side wall 77, the leg 76 is angled by the angle alpha and the leg 74 is angled from the leg 76 by the angle beta. Proceeding from the second side wall 78, the leg 73 is angled by the angle gamma, the leg 75 again being angled from the leg 73 by the angle beta. This means that the legs 73 and 74 are positioned flat against one another and the legs 75 and 76 are also positioned flat against one another. The end region 80 of the inner fin 79 is positioned flat in the area of the leg 76.

Figure 11:
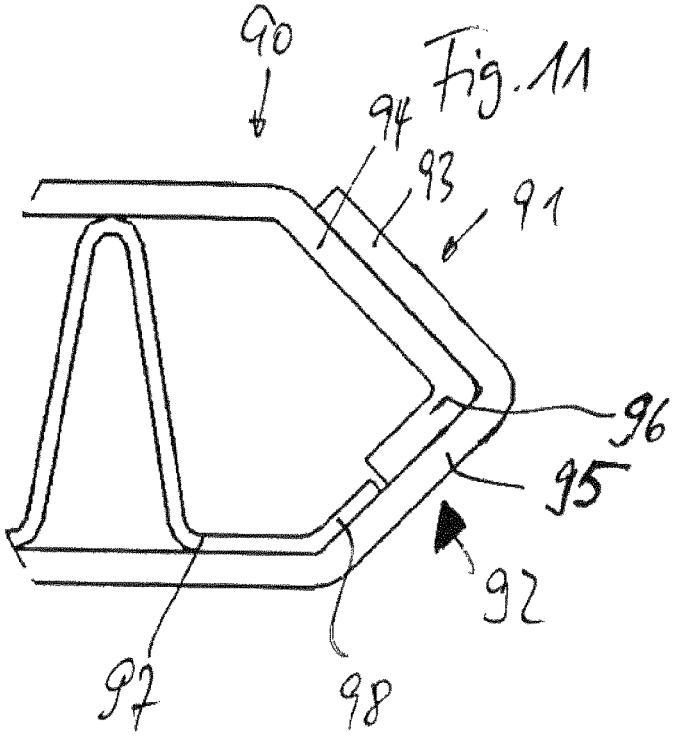
FIG. 11 depicts a section through part of an exemplary embodiment of a flat tube.

FIG. 11 illustrates another embodiment as an alternative to FIG. 10, wherein the third side wall is again provided in a double layer, at least in part. To this end, the leg 91 of the side wall 90 is provided in a double layer and at least part of the leg 92 is provided in a double layer. The leg 91 is formed by the leg 93 and the leg 94 of the material strip, wherein the leg 92 is formed by the leg 95 and the leg 96 of the material strip. It can be seen that the leg 96 has only about half the length, preferably a fraction of the length, of the leg 95, such that the leg 96 is positioned against the leg 95 across only part of the latter. It can furthermore be seen that the fin 97 is positioned against the leg 95 in the region thereof, wherein the leg 98 of the fin 97 is positioned against the leg 95 in the region exposed by the leg 96 that is reduced in length. The legs 96 and 98 are therefore positioned against the leg 95 adjacent to one another.

Figure 12:
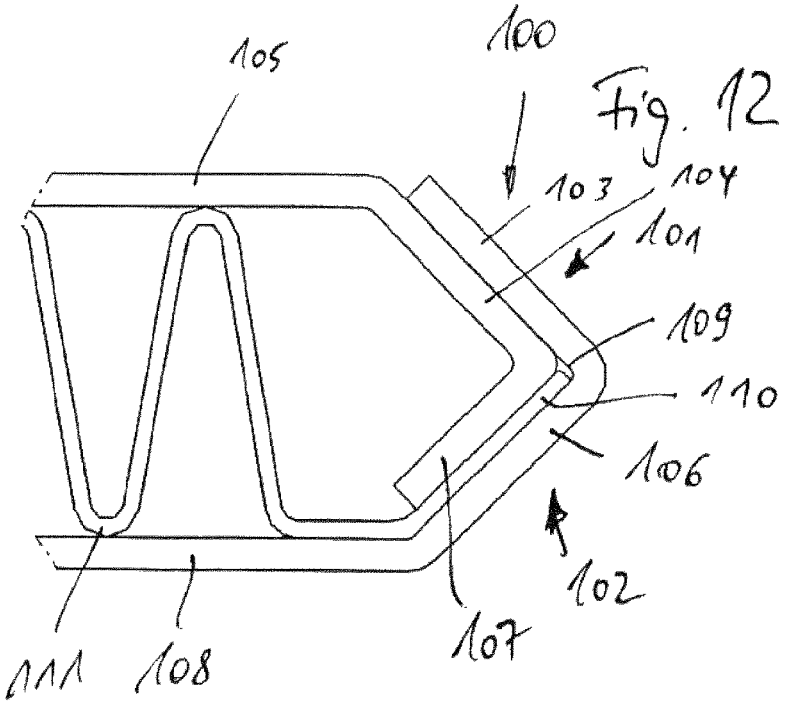
FIG. 12 depicts a section through part of an exemplary embodiment of a flat tube.

FIG. 12 depicts another exemplary embodiment for a design of a side wall of a flat tube according to the invention, wherein the side wall 100 is again formed in a double layer by the legs 101 and 102, wherein the leg 101 is formed by the leg 103 and the leg 104, which are arranged in a double layer parallel to one another and angled to the first side wall 105.

The leg 102 is formed by the leg 106 and the leg 107, which are arranged angled opposing the second side wall 108, wherein in this exemplary embodiment the two legs 107 and 108 are not positioned flush against one another, but instead at a distance that forms a gap, such that the end region 110 of the fin 111 can engage in this gap 109. This means that the leg 110 of the fin can be inserted and soldered between the leg 106 and the leg 107 of the side wall.

Figure 13:
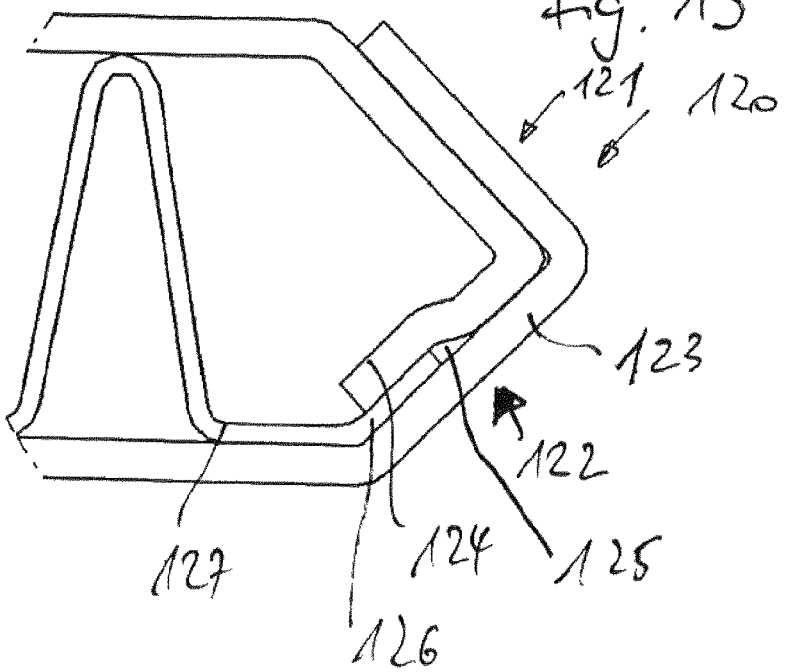
FIG. 13 depicts a section through part of an exemplary embodiment of a flat tube.

FIG. 13 illustrates another exemplary embodiment as an alternative to the exemplary embodiment in FIG. 12, wherein in this exemplary embodiment the third side wall 120 is formed by the side wall 121 and the side wall 122. The side wall 121 is provided in a double layer analogous to the side wall 101 in FIG. 12. The leg 122 of the side wall 120 is formed by the leg 123 and the leg 124, wherein across a part of its extension the leg 124 is positioned against the leg 123 and in another part of its extension it is spaced apart therefrom by a gap, wherein the leg 126 of the fin 127 extends into the gap 125 so that in this sub-region the leg 126 of the fin is arranged and soldered between the leg 124 and the leg 123.

Figure 14:
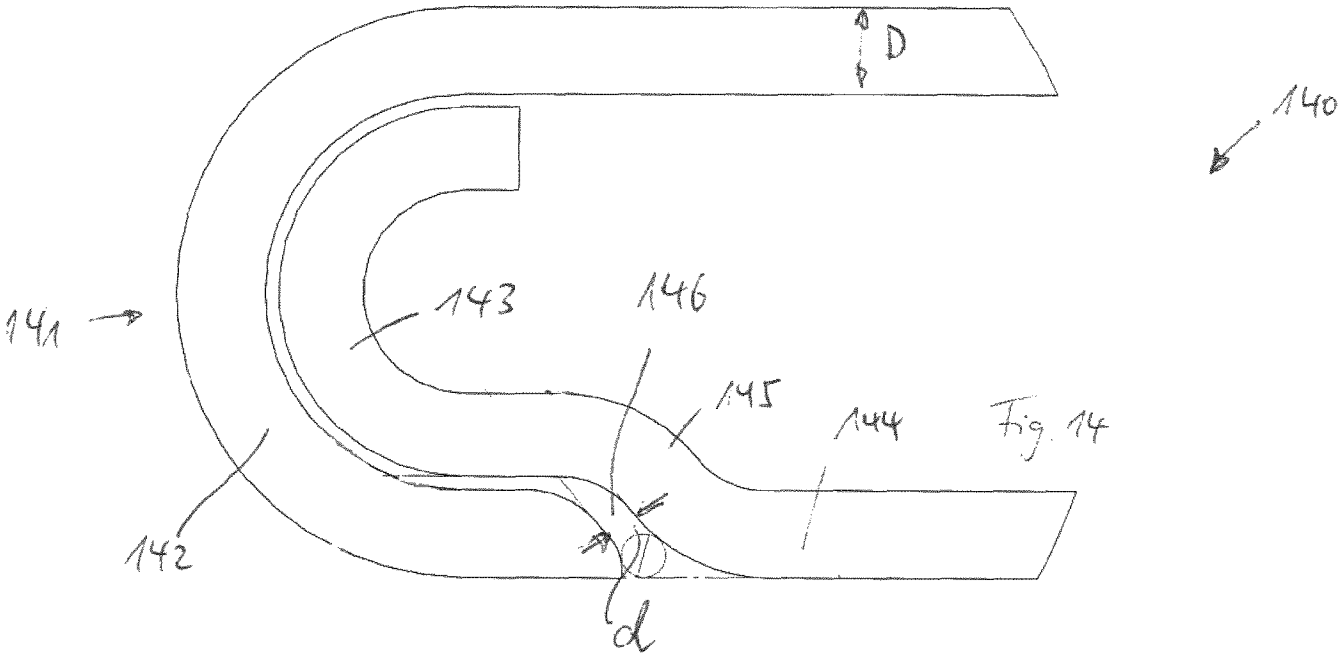
FIG. 14 depicts a section through part of an exemplary embodiment of a flat tube.

FIG. 14 illustrates a partial view of another exemplary embodiment of a flat tube 140 according to the invention. The third side wall 141 is formed by two overlapping regions 142, 143, each of which is provided as a curved region. The region 143 transitions from the straight region of the first side wall 144 with an S-shaped course 145 to the curved region 143, which describes a circular arc. The region 142 is also provided in a circular arc and is positioned exteriorly against the circular arc of the region 143. The circular arc of the region 142 terminates with a tapering such that the gap 146 between the two regions 142, 143 or 145 is as small as possible and preferably is provided in a wedge-shape with an acute angle of less than 30°. The distance d between the regions is also as small as possible, such as in particular smaller than the material thickness D.

Figure 15:
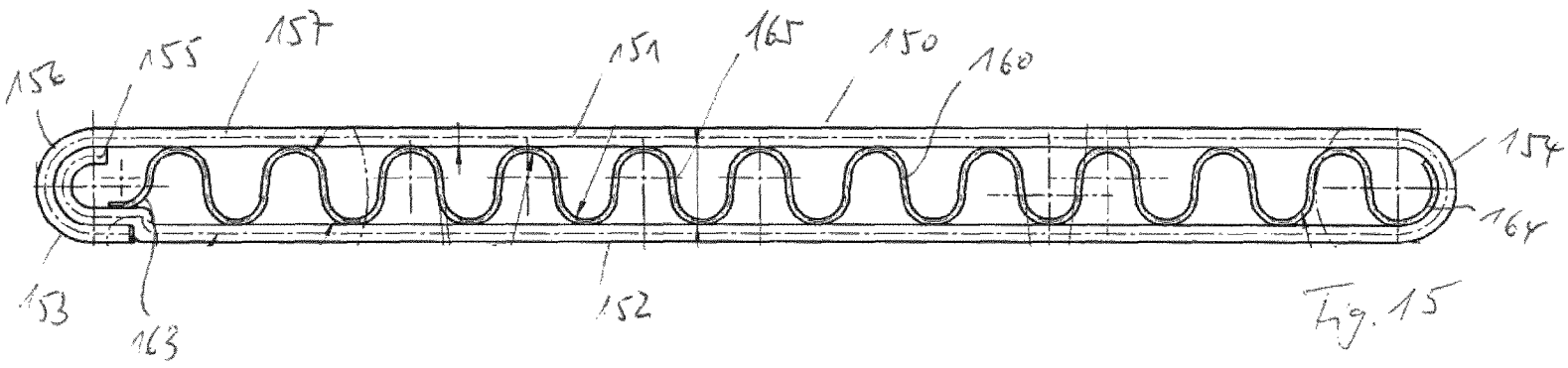
FIG. 15 depicts a section through an exemplary embodiment of a flat tube.

FIG. 15 illustrates an exemplary embodiment of a flat tube 150 in section, wherein the flat tube 150 comprises two mutually opposing first and second side walls 151, 152 and two mutually opposing third and fourth side walls 153, 154, the third and fourth side walls 153, 154 connecting the first and second side walls 151, 152 to one another. Thus the side 154 as the fourth side connects the two first and second side walls 151 and 152 on the right-hand side in the exemplary embodiment in FIG. 15 and the third side wall 153 connects the two first and second side walls 2151 and 152 on the left-hand side in the exemplary embodiment. The flat tube 150 may be recognized as such, which means that the extension of the third and fourth side walls 153, 154 is significantly shorter than the extension of the first and second side walls 151, 152.

As is apparent, the first, second, and fourth side walls 151, 152, 154 are each provided in a single layer, wherein the third side wall 153 is formed by two sections 155, 166 of the material strip 157 of the flat tube that are positioned against one another in a double layer forming a type of double wall. In the exemplary embodiment in FIG. 15, it is advantageous that the third and fourth side walls 153, 154 are provided in curves. Curve can preferably mean semi-circular or curved in some other manner. The third side wall 153 has an inner wall and an outer wall, the inner wall, proceeding from the first side wall 151, transitioning with a step to the curved contour so that the end region of the outer side wall is positioned thereagainst in the region of this step.

FIG. 15 shows the inner fin 160 that is inserted into the flat tube 150. The design of the inner fin 160 is such that a curved contour is provided on one of the two end regions 164, while at the other end region 163 the inner fin terminates in a straight line. Provided between the end regions 163, 164 is a meandering contour 165 with fins and curves. This means that the curved contour of the inner fin 160 is positioned against one of the curved contours of the flat tube in the region 164, while the straight region 163 is positioned on the side against the region 155.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A flat tube for a heat exchanger, the flat tube comprising:

a flat material strip having two mutually opposing first and second side walls that are connected to one another via third and fourth side walls, the third side wall being formed by two sections of the material strip that are positioned one against the other in a double-layer; and an internal fin arranged in an interior of the flat tube, the internal fin at the end sides is positioned against the third side wall and against the fourth side wall, and the internal fin, between the third side wall and the fourth side wall, is supported alternately against the first side wall and against the second side wall, wherein the internal fin at one end region is curved or angled and is positioned against the third side wall and at the other end region is curved or angled and is positioned against the fourth side wall, wherein the third side wall is formed with an inner material strip that extends from the first side wall and an outer material strip that extends from the second side wall, the inner material strip being positioned between the outer material strip and the one end region of the internal fin, wherein, in a transition region from the first side wall to the inner material strip of the third side wall, an arc, step, or incline is provided on the inner material strip, and wherein the outer material strip is positioned against the inner material strip and a distal end of the outer material strip terminates in a region of the arc, step, or incline of the inner material strip, the distal end of the outer material strip being tapered to fit the contour of the inner material strip in the region of the arc, step or incline to form a flush closure, wherein the one end region of the internal fin has a first portion having a same contour as the inner material strip of the third side wall and has a second portion having an arc, step or incline that has a same contour as the arc, step or incline of the transition region from the first side wall to the inner material strip, and wherein an entirety of the arc, step or incline of the second portion of the internal fin is positioned against and directly contacts the arc, step or incline of the transition region between the first side wall and the inner material strip of the third side wall.

2. The flat tube according to claim 1, wherein the third side wall has an angled or curved contour.

3. The flat tube according to claim 1, wherein the fourth side wall has an angled or curved contour.

4. The flat tube according to claim 1, wherein one end region of the internal fin is accommodated between two sections of the material strip that form the third side wall and that are positioned against one another in a double layer.

5. The flat tube according to claim 1, wherein the flat tube has a tube width between 9 mm and 60 mm, and/or a tube height between 1.5 mm and 30 mm, and/or a wall thickness for the material strip between 160 μm and 500 μm, and a wall thickness for the inner fin between 60 and 200 μm.

6. The flat tube according to claim 1, wherein, prior to insertion into the material strip, dimensions of the inner fin are smaller than or equal to the inner dimensions of the material strip such that the inner fin is inserted without pre-stress into the material strip.

7. A heat exchanger with a tube fin block having a plurality of flat tubes that are arranged between collecting spaces and are in fluid communication therewith, wherein corrugated fins are arranged between the flat tubes of the tube fin block, and wherein at least one of the flat tubes is a flat tube according to claim 1.

8. The flat tube according to claim 1, wherein the one end region of the internal fin is curved and the third side wall has a curved contour, such that the curved one end region of the internal fin is positioned against the curved contour of the third side wall, and wherein the other end region of the internal fin is curved and the fourth side wall has a curved contour, such that the curved other end region of the internal fin is positioned against the curved contour of the fourth side wall.

* * * * *